US007028512B2

(12) United States Patent
Chang

(10) Patent No.: US 7,028,512 B2
(45) Date of Patent: Apr. 18, 2006

(54) WASHING MACHINE

(75) Inventor: Jae won Chang, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 10/160,245

(22) Filed: Jun. 4, 2002

(65) Prior Publication Data

US 2003/0110816 A1 Jun. 19, 2003

(30) Foreign Application Priority Data

Dec. 17, 2001 (KR) ..... P2001-80139

(51) Int. Cl.
*D06F 17/00* (2006.01)

(52) U.S. Cl. ..... 68/53; 68/133

(58) Field of Classification Search ..... 68/23.6, 68/53, 131–134; 74/23–25
See application file for complete search history.

(56) References Cited

U.S. PATENT DOCUMENTS 2,145,453 A * 1/1939 Miller ..... 68/28
3,216,225 A 11/1965 Gil et al.
4,807,452 A * 2/1989 Brenner ..... 68/23.3
5,487,284 A * 1/1996 Kim et al. ..... 68/3 SS
5,617,747 A * 4/1997 Kim ..... 68/53
5,657,651 A * 8/1997 Oh et al. ..... 68/131
5,680,779 A * 10/1997 Na ..... 68/133
5,765,405 A 6/1998 Jung et al.
5,791,167 A * 8/1998 Wyatt et al. ..... 68/134
5,862,685 A * 1/1999 Lim ..... 68/23.7
6,176,108 B1 * 1/2001 Bae et al. ..... 68/23.7
6,332,343 B1 * 12/2001 Koketsu et al. ..... 68/23.7

FOREIGN PATENT DOCUMENTS

DE 195 48 106 C2 5/1997

* cited by examiner

*Primary Examiner*—Joseph L. Perrin
(74) *Attorney, Agent, or Firm*—Birch, Stewart, Kolasch & Birch, LLP

(57) ABSTRACT

A washing machine is provided, which washes laundry by mechanisms of vibration or/and pumping, thereby improving washing performance, and preventing the laundry from being damaged while reducing consumption of washing water. The washing machine includes an outer tub for storage of washing water, a washing tub mounted in the outer tub, an impeller rotatably fitted in a lower part of an inside of the washing tub for pumping the washing water in a space between the washing tub and the outer tub, a washing plate up and down movably fitted inside of the washing tub, a driving motor under the outer tub, and a power transmission connected to the driving motor for transmitting a rotation power of the driving motor to the impeller with a reduced speed, and transmitting a rotation power of the driving motor to the washing plate with the rotation power converted into up and down direction power.

18 Claims, 6 Drawing Sheets

WASHING MACHINE

This application claims the benefit of the Korean Application No. P2001-80139 filed on Dec. 17, 2001, which is hereby incorporated by reference.

BACKGROUND OF THE INVENTION

1. Field of the Invention

The present invention relates to a washing machine, and more particularly, to a washing machine that washes laundry by mechanisms of vibration or/and pumping, thereby improving washing performance, as well as preventing the laundry from being damaged while reducing consumption of washing water.

2. Background of the Related Art

Generally, the washing machine is an appliance for washing laundry by washing water circulation formed by forced circulation of washing water, friction caused by the water circulation, softening action of detergent, and the like. In general, a washing process of the washing machine has washing, rinsing, spinning, and water supply/draining cycles.

FIG. 1 illustrates a typical related art washing machine of a pulsator type in which a washing tub 100 and a pulsator 200 are designed to be selectively rotated by a clutch 400 connected to a motor 300 depending on the washing or spinning cycle, for, in the washing or rinsing cycle, pulsating only the pulsator 200 to form the water circulation for carrying out washing while the washing tub 100 remains stationary, and, in the spinning cycle, spinning the washing tub 100 for extracting water.

Accordingly, when a user applies a power to the washing machine, selects a washing method appropriately selected according to a sort of the laundry, and carries out the washing, the washing machine senses weight of the laundry, sets a water level and time periods under the control of a microcomputer (not shown), and progresses the washing according to a preset sequence of cycles of washing, rinsing, spinning and water supplying/draining.

Meanwhile, a direct motor coupled type washing machine, developed and used as a type different from the related art pulsator type washing machine, has the washing tub and the pulsator formed as one unit and designed to be directly driven by BLDC motor without a clutch.

However, the related art pulsator type washing machine has the following problems.

First, in view of washing principle, the foregoing pulsator type washing machine is required to be supplied with a certain amount of the washing water (10 l/kg) for a unit amount of the laundry for forming a strong water circulation, that causes waste of the washing water.

Along with this, the related art pulsating type washing machine, obtaining a washing power from water circulation caused by the alternative rotation of the washing tub and the pulsator, has problems of laundry entangling, and laundry damage due to the entangling of the laundry coming from the rotation of the washing tub.

Particularly, fine and thin laundry, such as underwear and high quality clothing, may be easily entangled and suffer from damage even though the washing tub is rotated at a low speed.

SUMMARY OF THE INVENTION

Accordingly, the present invention is directed to a washing machine that substantially obviates one or more problems due to limitations and disadvantages of the related art.

An object of the present invention is to provide a washing machine which can improve washing performance as well as prevent laundry damage while washing water consumption is reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes an outer tub for storage of washing water, a washing tub mounted in the outer tub, a washing plate up and down movably fitted inside of the washing tub, a driving motor under the outer tub, and a power transmission means connected to the driving motor for transmitting a rotation power of the driving motor to the washing plate with the rotation power converted into up and down direction power.

At this time, the power transmission means includes a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, cylindrical cams each having a guide groove in an outside surface thereof for up and down movement of a follower body coupled to top of the planetary gear for making rotation and revolution together with the planetary gear, a hollow cylindrical upper washing shaft fitted to top of the cams to pass through an upper surface of the housing, an elevating shaft up and down movably fitted inside of the upper washing shaft and provided with the washing plate to top thereof for making up and down movement together with the washing plate when the cams rotate, and rolling members provided to a lower part of the elevating shaft by moving along the guide grooves in the cams when the cams rotate for moving the elevating shaft in up and down directions.

Also, a plurality of projections and/or holes are formed on the washing plate.

In another aspect of the present invention, a washing machine includes an outer tub for storage of washing water, a washing tub mounted in the outer tub, an impeller rotatably fitted in a lower part of an inside of the washing tub for pumping the washing water in a space between the washing tub and the outer tub, a driving motor under the outer tub and a power transmission means connected to the driving motor for transmitting a rotation power of the driving motor to the impeller with a reduced speed.

At this time, the power transmission means includes a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, and a hollow cylindrical upper washing shaft fitted to top of the planetary gears, to pass through an upper surface of the housing, and provided with the impeller in an upper part thereof for rotating with the revolution of cams to rotate the impeller.

Also, at least one water circulation guide plate is fitted to an inside of the washing tub with a gap to an inside surface of the washing tub to form a flow guide passage, so that the washing water, pumped from a space between the washing tub and the outer tub, is guided to rise and be discharged toward a central part of the washing tub as the impeller rotates.

Preferably, the water circulation guide plate has at least one pumped water discharge hole formed on a longitudinal direction of the water circulation guide plate at fixed intervals for discharging the water rising along the flow guide passage toward the central part of the washing tub. At this time, the pumped water discharge hole formed in the water circulation guide plate is a horizontally elongated hole.

Also, water discharge holes are formed except for a part where the water circulation guide plate is formed in the washing tub.

A hub is fixed to the bottom surface of the washing tub, for securing an overall rigidity of the washing tub, which has water holes allowing the washing water in the space between the washing tub and the outer tub to flow into the washing tub during pumping.

Ball bearings are fitted to outside of a spinning shaft at the top of the housing and outside of the lower washing shaft respectively, and a bearing housing fixed to underside of the outer tub to enclose the ball bearings and the power transmission means.

In another aspect of the present invention, a washing machine includes an outer tub for storage of washing water, a washing tub mounted in the outer tub, an impeller rotatably fitted in a lower part of an inside of the washing tub for pumping the washing water in a space between the washing tub and the outer tub, a washing plate up and down movably fitted inside of the washing tub, a driving motor under the outer tub and a power transmission means connected to the driving motor for transmitting a rotation power of the driving motor to the impeller with a reduced speed, and transmitting a rotation power of the driving motor to the washing plate with the rotation power converted into up and down direction power.

At this time, the power transmission means includes a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, cylindrical cams each having a guide groove in an outside surface thereof for up and down movement of a follower body, coupled to top of the planetary gear for making rotation and revolution together with the planetary gear, a hollow cylindrical upper washing shaft fitted to top of the cams, to pass through an upper surface of the housing, and provided with the impeller in an upper part thereof for rotating with the revolution of cams to rotate the impeller, an elevating shaft up and down movably fitted inside of the upper washing shaft and provided with the washing plate to top thereof for making up and down movement together with the washing plate when the cams rotate, and rolling members provided to a lower part of the elevating shaft by moving along the guide grooves in the cams when the cams rotate for moving the elevating shaft in up and down directions.

Also, a plurality of projection and/or holes are formed on the plate.

At least one water circulation guide plate is fitted to an inside of the washing tub with a gap to an inside surface of the washing tub to form a flow guide passage, so that the washing water, pumped from a space between the washing tub and the outer tub, is guided to rise and be discharged toward a central part of the washing tub as the impeller rotates.

Also, the water circulation guide plate has at least one pumped water discharge hole formed in a longitudinal direction of the water circulation guide plate at fixed intervals for discharging the water rising along the flow guide passage toward the central part of the washing tub. At this time, the pumped water discharge hole formed in the water circulation guide plate is a horizontally elongated hole.

Water discharge holes are formed except for a part where the water circulation guide plate is formed in the washing tub.

Also, a hub is fixed to the bottom surface of the washing tub, for securing an overall rigidity of the washing tub, which has water holes allowing the washing water in the space between the washing tub and the outer tub to flow into the washing tub during pumping.

Ball bearings are fitted to outside of a spinning shaft at the top of the housing and outside of the lower washing shaft respectively, and a bearing housing fixed to underside of the outer tub to enclose the ball bearings and the power transmission means.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

A washing machine according to the preferred embodiments of the present invention will be described in detail with reference to FIG. 2A to FIG. 5.

For convenience of description, a case in which vibration and pumping mechanisms are operative simultaneously will be described referring to FIG. 2A to FIG. 4.

Figure 1:
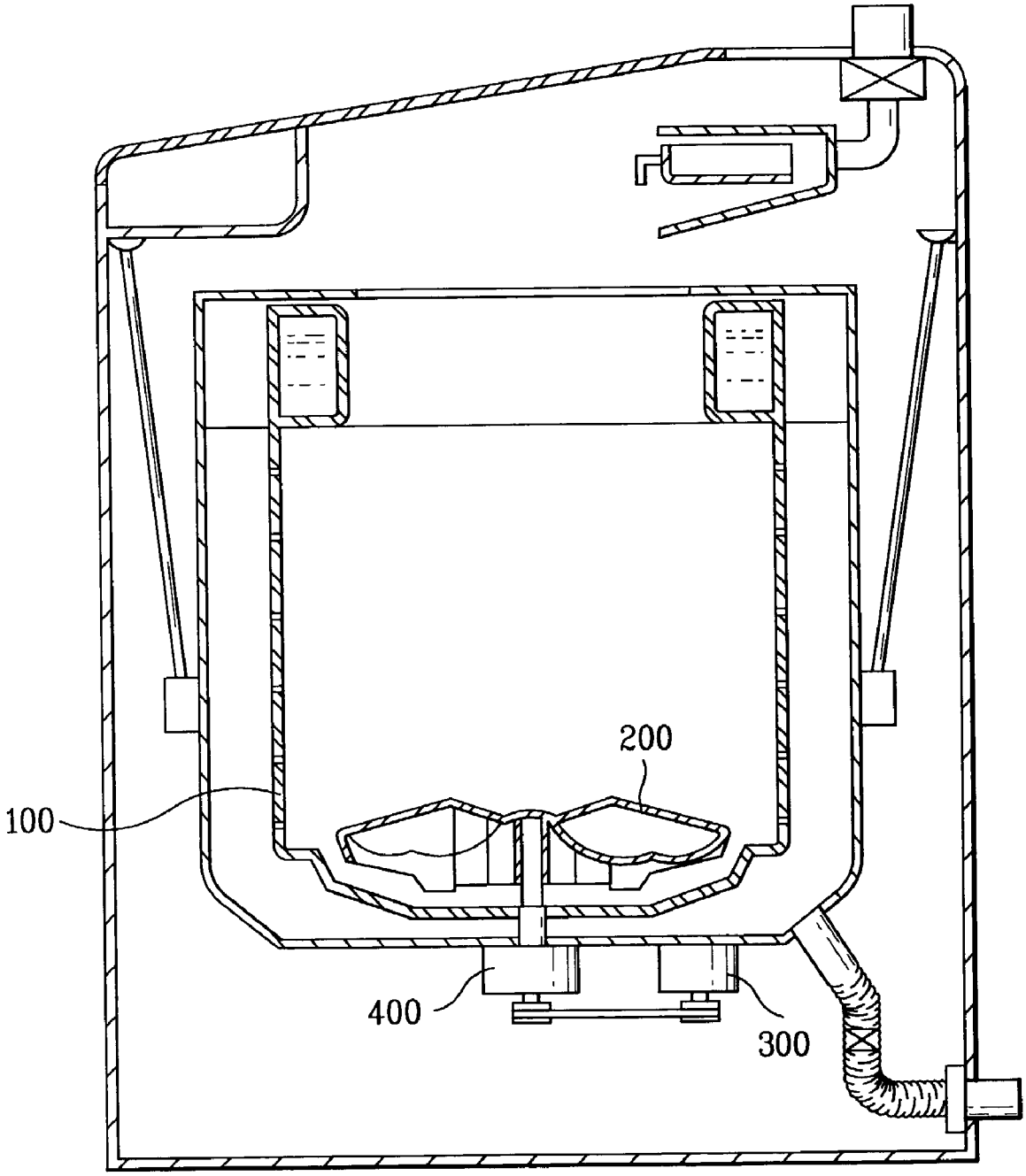
FIG. 1 Prior Art
FIG. 1 is a longitudinal section illustrating a related art pulsator type washing machine.
Figure 2A:
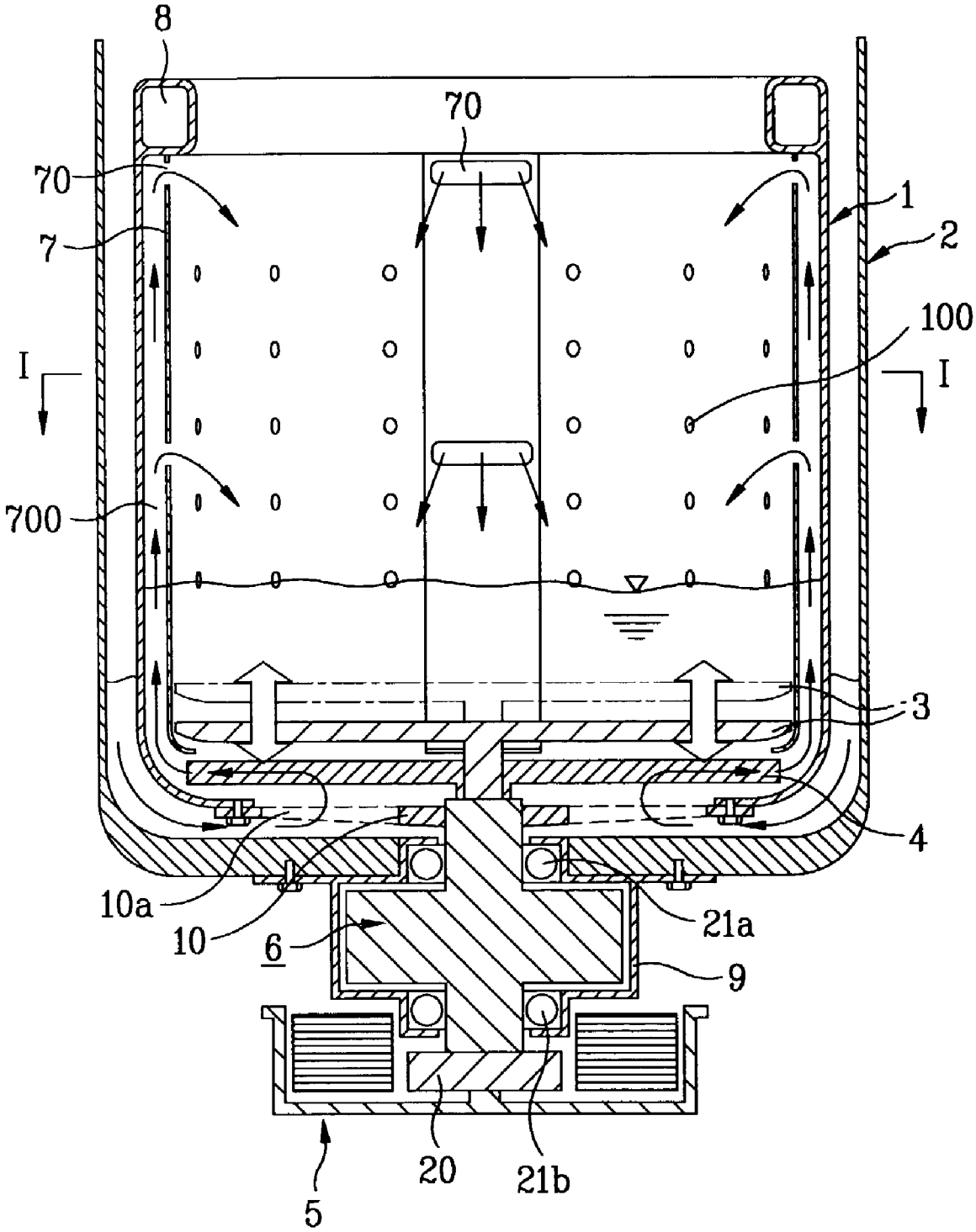
FIG. 2A is a longitudinal section illustrating a washing machine according to a preferred embodiment of the present invention.
Figure 2B:
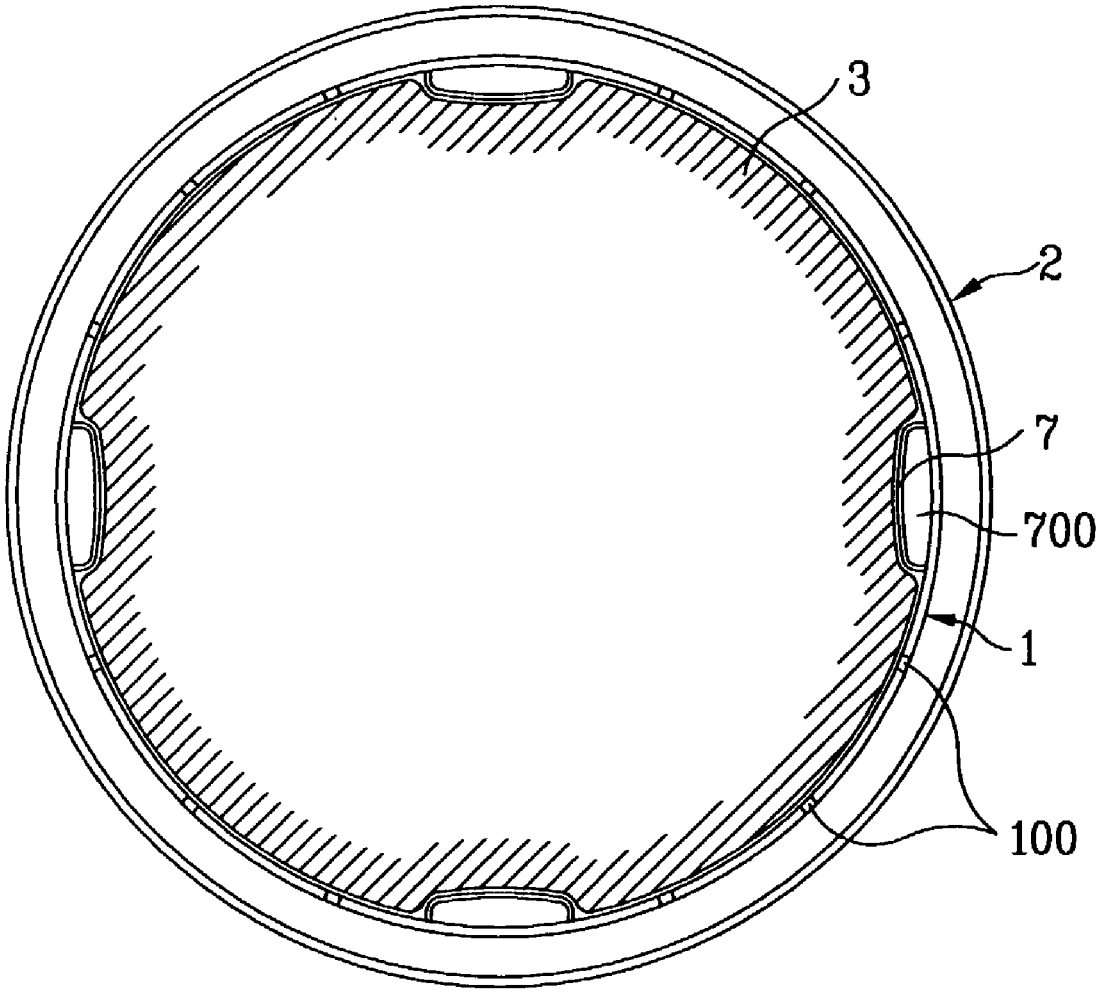
FIG. 2B is a cross section illustrating a washing machine across line I–I' of FIG. 2A.
Figure 3:
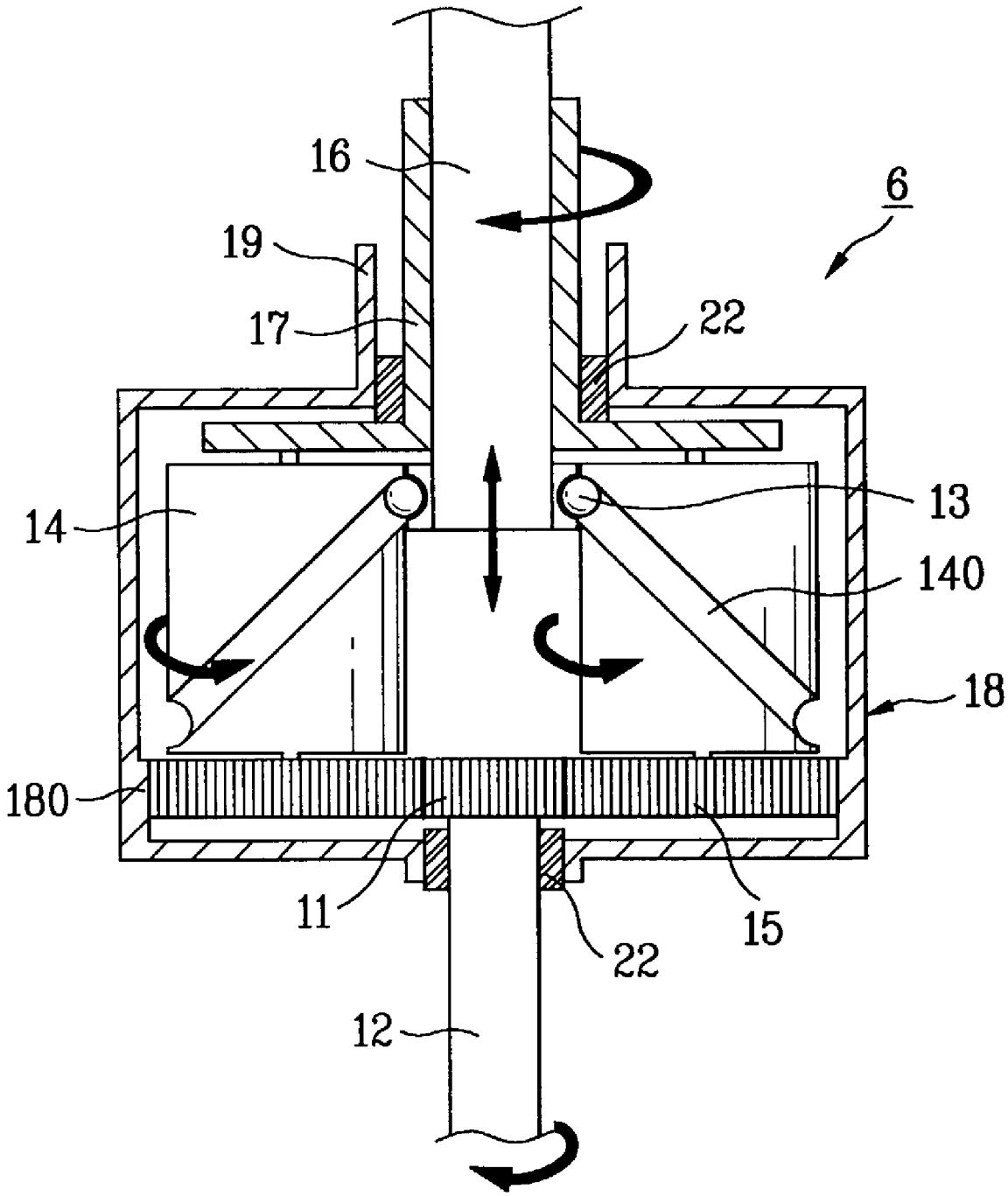
FIG. 3 is an enlarged detailed view illustrating key parts of FIG. 2A.
Figure 4:
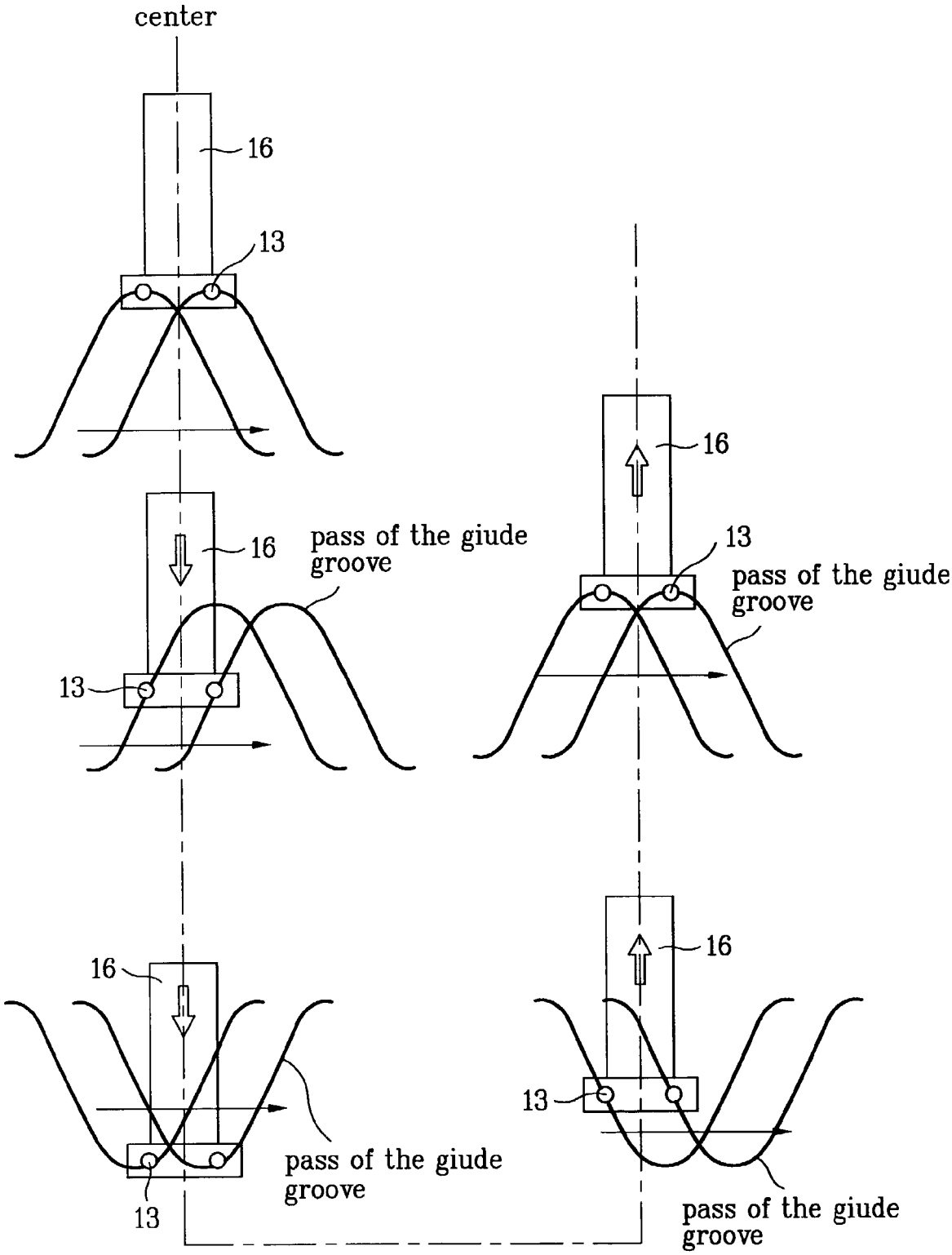
FIG. 4 is a conceptual view illustrating an operating principle of vibration mechanism applied to the present invention.

FIG. 2A is a longitudinal section illustrating a washing machine according to a preferred embodiment of the present invention, FIG. 2B is a cross section illustrating a washing machine across a line I–I' of FIG. 2A, FIG. 3 is an enlarged detailed view illustrating key parts of FIG. 2A, and FIG. 4 is a conceptual view illustrating an operating principle of the vibration mechanism applied to the present invention.

The washing machine of the present invention is provided with an outer tub 2 for storage of washing water, a washing tub 1 mounted in the outer tub 2, an impeller 4 rotatably fitted in a lower part of an inside of the washing tub 1 for pumping the washing water in a space between the washing tub 1 and the outer tub 2, a washing plate 3 up and down movably fitted inside of the washing tub 1, a driving motor 5 under the outer tub 2, and power transmission means 6 connected to the driving motor 5 for transmitting a rotation power of the driving motor 5 to the impeller 5 with a reduced speed, and transmitting a rotation power of the driving motor 5 to the washing plate with the rotation power converted into up and down direction power.

The power transmission means 6 is provided with a lower washing shaft 12 for receiving the rotation power of the driving motor 5 and being rotated by the rotation power, a cylindrical housing 18 coupled under the washing tub 1 having a bottom surface the lower washing shaft 12 is fitted thereto to pass therethrough, and an inside circumference of a lower part gear teeth 180 are formed therein, a sun gear 11 coupled to a top end of the lower washing shaft 12, a plurality of planetary gears 15 engaged both with the sun gear 11 and the gear teeth 180 in the inside circumference of the housing 18 for making rotation and revolution when the lower washing shaft 12 rotates, cylindrical cams 14 each having a guide groove 140 in an outside surface thereof for up and down movement of a follower body coupled to top of the planetary gear for making rotation and revolution together with the planetary gear, a hollow upper washing shaft 17 fitted to top of the cams 14, to pass through an upper surface of the housing 18, and provided with the impeller in an upper part thereof for rotating with the revolution of cams 14 to rotate the impeller 4, an elevating shaft 16 up and down movably fitted inside of the upper washing shaft 17 and provided with the washing plate 3 to top thereof for making up and down movement together with the washing plate 3 when the cams 14 rotate, and rolling members 13 provided to a lower part of the elevating shaft 16 for moving along the guide grooves 140 in the cams 14 when the cams 14 rotate for moving the elevating shaft 16 in up and down directions.

The groove 140 in the outer surface of the cam 14 is a sine curve or cosine curve, and a section of the groove 140 is semi-circular. The rolling member 13 has a ball form to fit to the shape of the groove 140.

There is a spinning shaft 19 fitted to an upper end of the housing 18 to connect the housing to the washing tub 1. There is a clutch 20 between the driving motor 5 and the housing 18, for changing over a power transmission path so that the driving power of the motor is transmitted, not to the lower washing shaft 12, but to the housing 18 directly in the spinning, for making water extraction from the laundry by high speed rotation of the washing tub 1 coupled to the spinning shaft 19.

There is an oilless bearing 22 between the spinning shaft 19 fitted to top of the housing 18 and the upper washing shaft 17 inside of the spinning shaft 19. There is an oilless bearing 22 between the lower washing shaft 12 and the bottom surface of the housing 18, too.

There are ball bearings 21*a*, and 21*b* fitted to outside of the spinning shaft 19 at the top of the housing, and outside of the lower washing shaft 12 in the power transmission means 6 respectively, and outside of which ball bearings 21*a* and 21*b* there is the bearing housing 9 fixed to underside of the outer tub 2 to enclose the ball bearings 21*a* and 21*b* and the power transmission means 6.

Meanwhile, there is at least one water circulation guide plate 7 fitted to an inside of the washing tub 1 with a gap to an inside surface of the washing tub 1 to form a flow guide passage 700, so that the washing water, pumped from a space between the washing tub 1 and the outer tub 2 as the impeller 4 fitted to the upper washing shaft 17 rotates, is guided to rise and be discharged toward a central part of the washing tub 1.

The water circulation guide plate 7 has at least one pumped water discharge hole 70 formed in a longitudinal direction of the water circulation guide plate 7 at fixed intervals for discharging the water rising along the flow guide passage 700 toward the central part of the washing tub 1, again.

Preferably, the pumped water discharge hole 70 formed in the water circulation guide plate 7 is a horizontally elongated hole.

There are no water discharge holes 100 formed in a part where the water circulation guide plate 7 of the washing tub 1 is formed, for preventing the washing water, rising along the flow guide passage 700 between the water circulation guide 7 and the washing tub 1, from escaping toward the outer tub side in the middle of the rise.

There is a hub 10 fixed to the bottom surface of the washing tub 1, for securing an overall rigidity of the washing tub, which has water holes 10*a* allowing the washing water in the space between the washing tub 1 and the outer tub 2 to flow into the washing tub 1 during pumping.

The operation of the washing machine according to the preferred embodiment of the present invention will be described.

In washing, the clutch 20 is changed over such that a power of the driving motor 5 is transmitted only to the lower washing shaft, and the power of the driving motor 5 transmitted to the lower washing shaft 12 rotates the sun gear 11, thereby rotating the planetary gears 15 engaged with the sun gear 11.

The planetary gear 15 revolves as the planetary gear 15 is engaged with the gear tooth 180 in the lower part of the inside surface of the housing 18.

At this time, the cam 14 coupled to the top of each planetary gear 15 also revolves, when a ball, the rolling member 13 in the groove 140 in the outside surface of each cam 14, is rolled in the groove 140, leading the elevating shaft 16 supporting the ball to move up or down according to the movement of the ball.

That is, owing to the sine curve or cosine curve of the guide groove 140 in the outside surface of the cam 14 obtainable when the cam 14 is developed on a plane, as shown in FIG. 3, if the cam 14 revolves in a clockwise direction, the groove 140 moves in the right direction with respect to the ball as shown in FIG. 4, when the elevating shaft 16 keeps moving in up and down directions with a fixed stroke by the rolling of the ball and the movement of the groove 140 because the elevating shaft 16 is designed to move only in the up and down directions.

Along with the up and down movements of the elevating shaft 16, the upper washing shaft 17 the shafts of the planetary gears 15 are fixed thereto revolves at a reduced speed according to a gear ratio of the sun gear 11 and the planetary gear 15 engaged with the sun gear 11, and the impeller 4 coupled to the upper washing shaft 17 is also rotated at the same speed with the upper washing shaft 17.

At this time, the housing 18 fixed to the washing tub 1 remains stationary, and the upper washing shaft 17 revolves in the same direction with the lower washing shaft 12.

Accordingly, if the driving motor 5 is rotated in one direction, the washing can be done since the water circulation is formed as the washing plate 3 moves up and down, and, simultaneously, the impeller 4 is rotated.

That is, after the washing water in the space between the washing tub 1 and the outer tub 2 is introduced into the washing tub 1 through the water holes 10*a* in the hub 10 by a pressure difference generated between the water inside of the washing tub 1 and the water outside of the washing tub 1 due to the centrifugal force caused by the rotation of the impeller 4, as shown in an arrow of FIG. 2A, the washing water between the washing tub 1 and the outer tub 2 gives impact to the laundry as the washing water is pumped through a space between the washing tub 1 and the water circulating guide plate 7, and discharged toward the upper part of inside of the washing tub 1, and on the same time with this, the washing plate 3 gives impact to the laundry directly, while the washing plate 3 forms a vibratory water flow by the up and down movements.

In the foregoing structure, since the discharge holes 100 are formed in the washing tub 1 except the part where the water circulation guide plate 7 is fitted, escaping of the washing water rising through the flow guide passage 700 between the washing tub 1 and the water circulation guide plate 7 to an outer tub 2 side in the middle of the rise can be prevented, that facilitate to obtain a powerful discharge pressure.

Next, the spinning operation of the washing machine according to the preferred embodiment of the present invention will be described in detail.

In the spinning, the power of the driving motor 5 is transmitted both to the housing 18 and the lower washing shaft 12 by power transmission path change over action of the clutch 20, and the power transmitted to the housing 18 is transmitted to the washing tub 1 through the spinning shaft 19 provided to top of the housing 18, thereby spinning the washing tub 1 to extract the water.

Thus, the washing machine in accordance with the preferred embodiment of the present invention can make the washing done without giving damage to the fine and thin laundry, such as underwear by the up and down direction vibratory water flow caused by the up and down direction movement of the washing plate 3 and a waterfall water flow formed by the pumping of the impeller 4, instead of the powerful water circulation in the washing tub 1 in washing, that causes entangling of the laundry.

Moreover, the washing machine in accordance with the preferred embodiment of the present invention can reduce washing water consumption and enhance an energy efficiency because the washing can be done even with a small amount of washing water by the pumping action of the impeller 4 and the vibratory water flow caused by the up and down movement of the washing plate 3.

That is, though the washing water between the outer and inner tubs is not used in washing in the related art washing machine, since the washing machine in accordance with the preferred embodiment of the present invention can reduce a total amount of the washing water while an amount of washing water in the washing tub 1 is increased by reducing the washing water between the outer and inner tubs by the pumping action of the impeller as shown in FIG. 2A, the washing water consumption can be reduced.

Though a case the pumping mechanism and the vibration mechanism are put into action on the same time is described, it is possible that any one of pumping and vibration mechanisms is put into action, separately.

Figure 5:
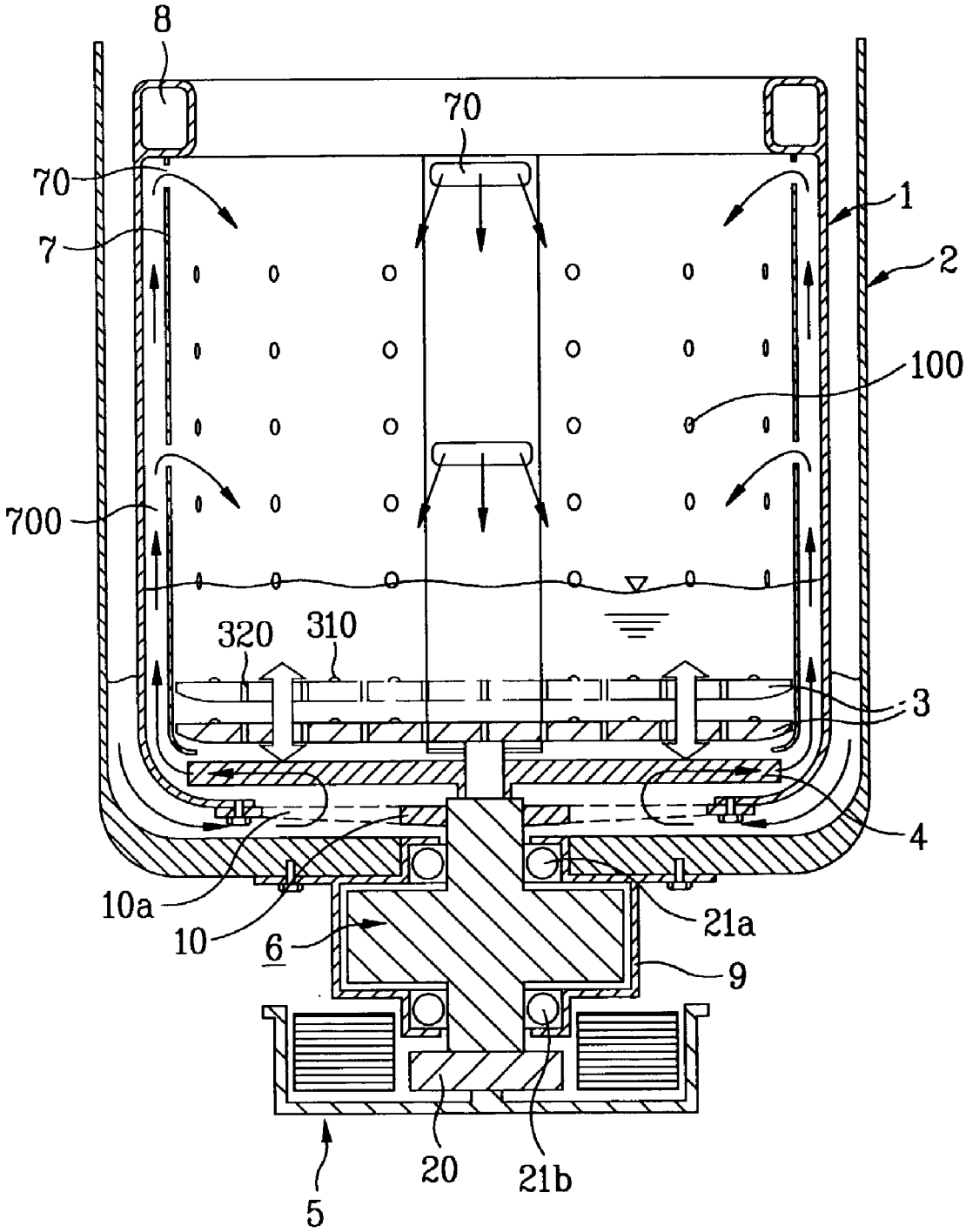
FIG. 5 is a longitudinal section illustrating a washing machine according to another preferred embodiment of the present invention.

FIG. 5 illustrates a washing machine according to another preferred embodiment of the present invention.

Referring to FIG. 5, the washing machine includes a plurality of projections from a top surface of the washing plate 3, and a plurality of holes 320 in the washing plate 3.

The foregoing washing machine has the following additional effects in addition to the effects described in the previous embodiment.

First, if the washing plate 3 moves down, the washing water under the washing plate 3 spurts from the holes 320 by the pressure of the plate 3, to give impact to the laundry above the washing plate 3.

Moreover, the holes 320 in the washing plate 3 form a plurality of bubbles in the washing water when the washing plate 3 moves up and down.

When the washing plate 3 moves up, the washing water above the washing plate 3 moves down to a lower part of the washing plate 3, such that the laundry is pulled toward the washing plate 3, and strikes the washing plate 3, directly.

Especially, the plurality of projections 310 from the washing plate 3 provides a laundry pounding effect.

Accordingly, the plurality of holes 320 and the plurality of projections 310 at the plate 3 can improve the washing efficiency, further.

The driving motor in the foregoing embodiment of the present invention may be a general DC motor that transmits the power through a pulley and a belt, or a BLDC motor of a direct coupling type.

As described above, the washing machine according to one of the embodiments of the present invention has the following advantages.

The washing machine according to one of the embodiments of the present invention has reduced entangling or damage to the laundry compared to the formation of water circulation by rotating the pulsator or the washing tub alternately in the related art washing machine, because the washing machine of the present invention make the washing done by the up and down direction vibratory water flow in the washing tub. Especially, the washing machine of the present invention is advantageous for washing that requires special attention of the laundry, such as underwear, or high quality clothes.

Furthermore, the washing water consumption can be reduced, and a washing efficiency can be enhanced since the washing can be done even in using a small amount of water.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A washing machine comprising:

an outer tub for storage of washing water;

a washing tub mounted in the outer tub;

an impeller rotatably fitted in a lower part of an inside of the washing tub for pumping the washing water in a space between the washing tub and the outer tub;

a driving motor under the outer tub; and a power transmission connected to the driving motor for transmitting a rotation power of the driving motor to the impeller with a reduced speed, the power transmission comprising;

a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, and a hollow cylindrical upper washing shaft fitted to top of the planetary gears, to pass through an upper surface of the housing, and provided with the impeller in an upper part thereof for rotating with the revolution of cams to rotate the impeller.

2. The washing machine as claimed in claim 1, wherein at least one water circulation guide plate is fitted to an inside of the washing tub with a gap to an inside surface of the washing tub to form a flow guide passage, so that the washing water, pumped from a space between the washing tub and the outer tub, is guided to rise and be discharged toward a central part of the washing tub as the impeller rotates.

3. The washing machine as claimed in claim 2, wherein the water circulation guide plate has at least one pumped water discharge hole formed on a longitudinal direction of the water circulation guide plate at fixed intervals for discharging the water rising along the flow guide passage toward the central part of the washing tub.

4. The washing machine as claimed in claim 3, wherein the pumped water discharge hole formed in the water circulation guide plate is a horizontally elongated hole.

5. The washing machine as claimed in claim 2, wherein water discharge holes are formed except for a part where the water circulation guide plate is formed in the washing tub.

6. The washing machine as claimed in claim 1, wherein a hub is fixed to the bottom surface of the washing tub, for securing an overall rigidity of the washing tub, which has water holes allowing the washing water in the space between the washing tub and the outer tub to flow into the washing tub during pumping.

7. The washing machine as claimed in claim 1, wherein ball bearings are fitted to outside of a spinning shaft at the top of the housing and outside of the lower washing shaft respectively, and a bearing housing fixed to underside of the outer tub to enclose the ball bearings and the power transmission.

8. A washing machine comprising:

an outer tub for storage of washing water;

a washing tub mounted in the outer tub;

an impeller rotatably fitted in a lower part of an inside of the washing tub for pumping the washing water in a space between the washing tub and the outer tub;

a washing plate up and down movably fitted inside of the washing tub;

a driving motor under the outer tub; and a power transmission connected to the driving motor for transmitting a rotation power of the driving motor to the impeller with a reduced speed, and transmitting a rotation power of the driving motor to the washing plate with the rotation power converted into up and down direction power, the power transmission comprising:

a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, cylindrical cams each having a guide groove in an outside surface thereof for up and down movement of a follower body, coupled to top of the planetary gear for making rotation and revolution together with the planetary gear, a hollow cylindrical upper washing shaft fitted to top of the cams, to pass through an upper surface of the housing, and provided with the impeller in an upper part thereof for rotating with the revolution of cams to rotate the impeller, an elevating shaft up and down movably fitted inside of the upper washing shaft and provided with the washing plate to top thereof for making up and down movement together with the washing plate when the cams rotate, and rolling members provided to a lower part of the elevating shaft by moving along the guide grooves in the cams when the cams rotate for moving the elevating shaft in up and down directions.

9. The washing machine as claimed in claim 8, wherein a plurality of projection and/or holes are formed on the plate.

10. The washing machine as claimed in claim 8, wherein at least one water circulation guide plate is fitted to an inside of the washing tub with a gap to an inside surface of the washing tub to form a flow guide passage, so that the washing water, pumped from a space between the washing tub and the outer tub, is guided to rise and be discharged toward a central part of the washing tub as the impeller rotates.

11. The washing machine as claimed in claim 10, wherein the water circulation guide plate has at least one pumped water discharge hole formed in a longitudinal direction of the water circulation guide plate at fixed intervals for discharging the water rising along the flow guide passage toward the central part of the washing tub.

12. The washing machine as claimed in claim 11, wherein the pumped water discharge hole formed in the water circulation guide plate is a horizontally elongated hole.

13. The washing machine as claimed in claim 10, wherein water discharge holes are formed except for a part where the water circulation guide plate is formed in the washing tub.

14. The washing machine as claimed in claim 8, wherein a hub is fixed to the bottom surface of the washing tub, for securing an overall rigidity of the washing tub, which has water holes allowing the washing water in the space between the washing tub and the outer tub to flow into the washing tub during pumping.

15. The washing machine as claimed in claim 8, wherein ball bearings are fitted to outside of a spinning shaft at the top of the housing and outside of the lower washing shaft respectively, and a bearing housing fixed to underside of the outer tub to enclose the ball bearings and the power transmission.

16. The washing machine as claimed in claim 8, wherein the rotation power of the driving motor is transmittable to the washing tub by the power transmission for rotating the washing tub.

17. A washing machine comprising:

an outer tub for storage of washing water;

a washing tub mounted in the outer tub;

a washing plate up and down movably fitted inside of the washing tub;

a driving motor under the outer tub; and a power transmission connected to the driving motor for transmitting a rotation power of the driving motor to the washing plate with the rotation power converted into up and down direction power, the power transmission comprising:

a lower washing shaft for receiving the rotation power of the driving motor and being rotated by the rotation power, a cylindrical housing coupled under the washing tub having a bottom surface the lower washing shaft is fitted thereto to pass therethrough, and an inside circumference of a lower part gear teeth are formed therein, a sun gear coupled to a top end of the lower washing shaft, a plurality of planetary gears engaged both with the sun gear and the gear teeth in the inside circumference of the housing for making rotation and revolution when the lower washing shaft rotates, cylindrical cams each having a guide groove in an outside surface thereof for up and down movement of a follower body coupled to top of the planetary gear for making rotation and revolution together with the planetary gear, a hollow cylindrical upper washing shaft fitted to top of the cams to pass through an upper surface of the housing, an elevating shaft up and down movably fitted inside of the upper washing shaft and provided with the washing plate to top thereof for making up and down movement together with the washing plate when the cams rotate, and rolling members provided to a lower part of the elevating shaft by moving along the guide grooves in the cams when the cams rotate for moving the elevating shaft in up and down directions.

18. The washing machine as claimed in claim 17, wherein a plurality of projections and/or holes are formed on the washing plate.

* * * * *